US005894910A

United States Patent [19]

Suur-Askola et al.

[11] Patent Number: 5,894,910

[45] Date of Patent: Apr. 20, 1999

[54] PROCEDURE FOR CONTROLLING AN ELEVATOR

[75] Inventors: Seppo Suur-Askola; Timo Lehtonen, both of Riihimäki; Ralf Ekholm, Helsinki, all of Finland

[73] Assignee: Kone OY, Helsinki, Finland

[21] Appl. No.: 08/836,759

[22] PCT Filed: Nov. 22, 1995

[86] PCT No.: PCT/FI95/00647

§ 371 Date: Jul. 28, 1997

§ 102(e) Date: Jul. 28, 1997

[87] PCT Pub. No.: WO96/17798

PCT Pub. Date: Jun. 13, 1996

[30] Foreign Application Priority Data

Nov. 29, 1994 [FI] Finland ..... 945638

[51] Int. Cl.[6] ..... B66B 1/06

[52] U.S. Cl. ..... 187/290; 187/391

[58] Field of Search ..... 187/290, 391, 187/393

[56] References Cited

U.S. PATENT DOCUMENTS 4,399,892 8/1983 Watanabe ..... 187/290

FOREIGN PATENT DOCUMENTS 3-158369 7/1991 Japan ..... 187/290

*Primary Examiner*—Robert E. Nappi

[57] ABSTRACT

A velocity-controlled elevator drive including an a.c. motor (28) driving elevator machinery regulated by means of a frequency converter (26) supplying the motor (28) with a controlled frequency and voltage. The load condition of the elevator is measured by means of a load weighing device (32) in the elevator car. A power limit ($P_A$) is input to the elevator machinery as a reference value and the speed reference (38) given to the frequency converter is determined on the basis of the power limit ($P_A$) and the load condition.

4 Claims, 1 Drawing Sheet

PROCEDURE FOR CONTROLLING AN ELEVATOR

BACKGROUND OF THE INVENTION

The present invention relates to a procedure for regulating a velocity-controlled elevator drive in which an a.c. motor driving the elevator machinery is controlled by a frequency converter feeding the motor with a controlled frequency and voltage, said elevator drive being provided with devices detecting the load condition of the elevator.

An objective in the control of an elevator in a normal situation is to drive the elevator in such a way that, each time the elevator is operated, it will run through the distance between the starting floor and the target floor as fast as possible. Therefore, the elevator motor is generally so controlled that the acceleration, deceleration and speed of the elevator are in all circumstances as high as the machinery permits without causing inconvenience to passengers. For the control, it is required that the electric network supplying the elevator drive should produce sufficient power in all situations during elevator operation. In normal use, this is generally no problem.

When a disturbance occurs in the supply of power, the elevator will not work in the intended manner. To cope with power failures, elevators are provided with safety equipment enabling the elevator cars to be driven to landings. A longer break in the supply of electricity requires the connection of a reserve power system, which is generally designed to keep about one in four elevators available for use by passengers. In this case, the transport capacity of the elevators is dramatically reduced.

Disturbances may appear in the supply of electric energy even if no actual power failure occurs. The voltage in the electric supply network may fall below the nominal value or the frequency variations may exceed the allowed limits. In such cases, the protective devices used in the electric network and by the consumers of electricity are generally activated when certain preset limit values are reached. In elevator drives, such situations may occur in areas where the electricity distribution network is weak and also during construction when power is supplied by a temporary electricity supply system insufficient in capacity. When the voltage in the network falls, the load capacity of the network is generally reduced, so that a load of normal magnitude will cause an overload on the network, resulting in a further fall in the voltage, activation of protective equipment and break-off of power.

From patent specification U.S. Pat. No. 5,229,558, Kone Elevator GmbH, a solution is known in which the elevator is driven at a lower speed and/or acceleration when the supply voltage falls, correspondingly reducing the power requirement. However, this specification does not take the real power need of the elevator into account, but the transport capacity, i.e. the travelling speed of the elevator is reduced on-the basis of the condition of the electric network.

SUMMARY OF THE INVENTION

The object of the present invention is to achieve a new velocity-controlled elevator drive which works optimally when the network has a limited power supply capacity, e.g. during the use of a reserve power supply. A further object is to achieve a procedure for controlling the elevator motor that does not impose on the network a load exceeding the network tolerance but allows a maximal driving speed in different load situations. The procedure of the invention is characterized in that a power limit is input to the elevator machinery as a reference value and that the speed reference given to the frequency converter is determined on the basis of the power limit and the load condition.

According to an embodiment of the invention, the power limit is given as a relative value in relation to the nominal power of the elevator. According to another embodiment of the invention, the load condition is determined from the measurement signal of the load weighing device of the elevator. In a third embodiment of the invention, the power limit is determined according to the power supply capacity of the network.

With the invention, all energy available to the elevator drive is optimally utilized. This has a special importance in a reserve power situation, where the power available is limited to a clearly lower value than normal.

In the solution of the invention, the motor drive in the elevator control system is able to decide its running speed by itself in accordance with conditions given. An advantageous condition mode is to use relative power. By virtue of the properties of a new type of frequency converter used, the elevator can be started with 12–25% of nominal power even under the heaviest load conditions. However, this has the result that an empty elevator moves very slowly in the down direction. If there are passengers in the elevator car, the power required to drive downwards is reduced because the elevator is balanced to about 50% by the counterweight. In rescue operation, when the load is clearly over one half of the nominal load, mainly depending on the efficiency of the machinery, the elevator no longer needs power to move the car. However, motor magnetization and the control equipment require 10–25% of the nominal power.

For example, in the case of an elevator group comprising four elevators in which the reserve power capacity is designed on the principle typical of mid-sized buildings, the available energy is sufficient for one elevator in all operating situations. By using the solution of the invention, each one of the elevators can be allotted 25% of the nominal power. Depending on the load conditions, some or even all of the elevators can drive at full speed.

A significant advantage provided by the invention when applied in connection with reserve power operation is a feeling of safety created in the passengers, which is achieved by the fact that the elevators start moving again immediately after a power failure after the lights have been turned on again. Alternatively, depending on market needs and the resources available, part of the advantage regarding quality of service can be translated into a saving in expenditure and the present level of service can be attained for a considerably lower price. This advantage can be achieved e.g. in high-rise residential buildings, which generally have two elevators, which means that the waiting time is no problem, and the advantage is created by the fact that the nominal power of the reserve power system can be lowered either to about one half without significantly reducing the level of service quality or to about one fourth of the present power level while still guaranteeing rescue operation, though slow, with all elevators in all situations.

The invention provides a particularly great advantage in areas where power failures are very common. In this case, the solution of the invention allows almost normal or quasi normal elevator operation. Therefore, the abnormal situation does not necessarily require special instructions to be given, nor does it affect the behavior of passengers. As compared with a purely battery operated solution, the invention allows savings to be made in the costs of establishment and maintenance of an energy storage. Further advantages are achieved in the supply of electricity to the control and peripheral apparatus.

Another field of application where the invention offers a particularly great benefit are fire situations in very high buildings. In such buildings, so-called gearless elevators are used which have such a high coefficient of efficiency that, even with current technology, it makes sense to supply energy back into the network e.g. when the elevator is driving downwards with full load or upwards with an empty car. At best, the electric power returned corresponds to 90% of the nominal power. For this purpose, the motor drives are provided with a so-called controlled mains bridge, which produces a current of correct frequency, form and voltage.

In a fire situation, the elevators can utilize the energy produced by other elevators via the internal network of the building, and thus all elevators can in this case drive practically at full speed all the time because in a rescue situation the cars generally travel down with full load and up with an almost empty car, one fireman being generally always present in the car in such situations. The power generated by the other elevators prevents the occurrence of overload on the reserve power system if the elevator machinery is temporarily put on heavy duty e.g. when the elevator is driving down with an empty car.

A further advantage in a fire situation is that, if the elevators can be run at full capacity during rescue work, they can even generate a significant amount of extra power for other equipment in the building, such as normal lighting and pumps. Therefore, by using the solution of the invention, it will be beneficial to change the basic assumptions in the planning of rescue work and demand that full elevator service be available in high-rise buildings in the event of a fire and when rescue work relies on reserve power. This can be realized without significantly increasing the total costs.

The power limit can be set proportionally among the elevators in operation. In areas suffering from insufficient supply of electric power, this allows the power limit to be determined by considering other primary loads on the network or, if the power available varies with the times of the day, the power limit can also be adjusted according to the diurnal rhythm.

BRIEF DESCRIPTION OF THE DRAWINGS

In the following, the invention is described by referring to FIG. 1, which presents an elevator drive according to the invention.

DETAILED DESCRIPTION OF THE INVENTION

Figure 1:
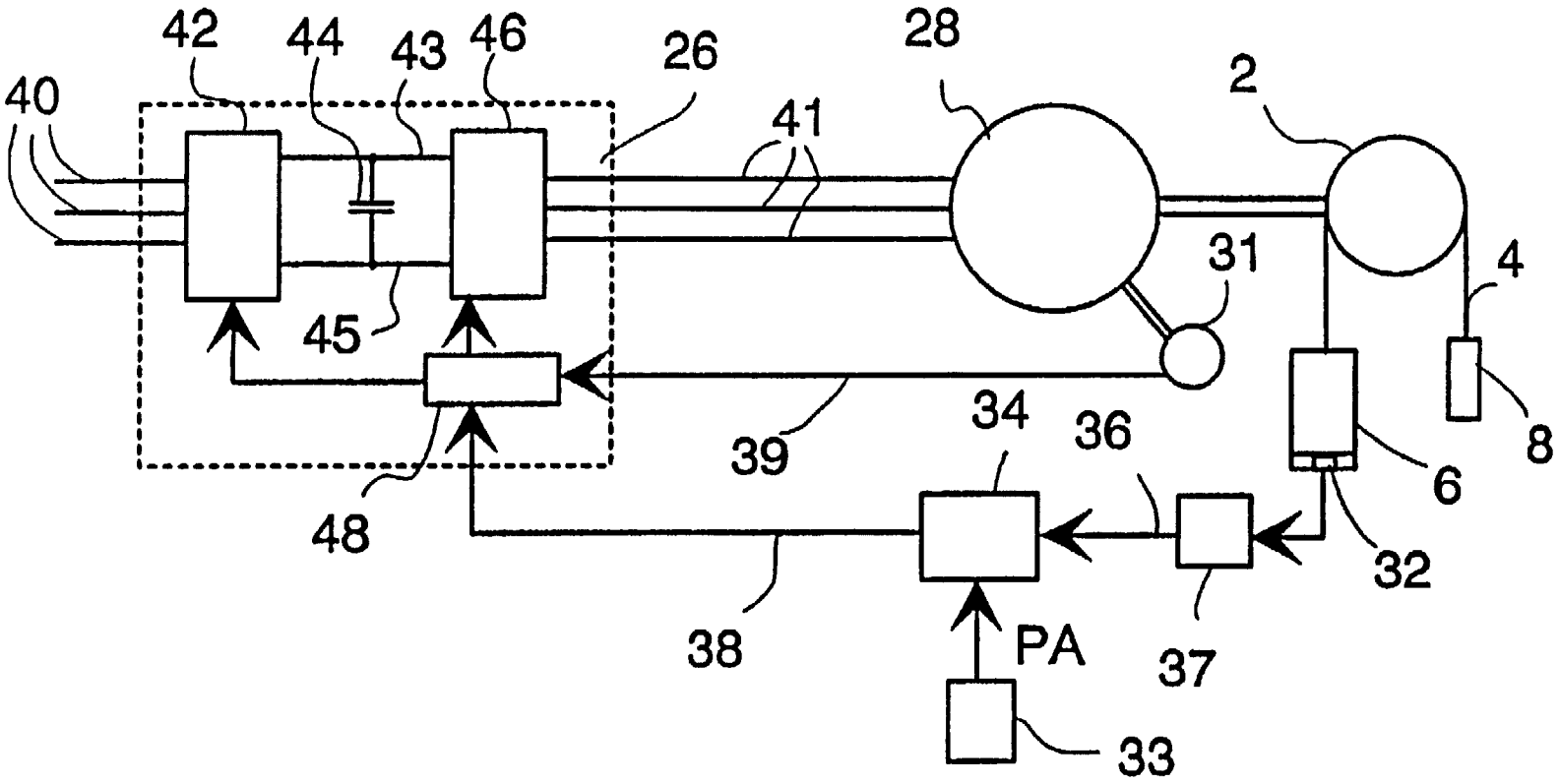

The hoisting motor 28 moves the elevator car 6 and counter weight 8 by means of elevator hoisting ropes 4 and a traction sheave 2 coupled to the motor shaft either directly or via a gear system, in a manner known in itself in elevator technology. The frequency converter 26 is connected to the power supply via three-phase conductors 40 and to the motor 28 via three-phase conductors 41. The elevator control system for its part takes care of the movements of the car/cars in accordance with the calls given by passengers and the internal instructions within the elevator system. The implementations of these vary considerably depending on the application and do not affect the action of the present invention. Each elevator has an individual nominal power, although the elevator group may of course consist of identical elevators of standard design.

The elevator load is measured by means of a load weighing device 32 mounted in the elevator car 6. Using the weight data, unit 37 generates a load signal 36 based on the masses of the mechanics and components of the hoisting system of the elevator. The load data indicates the load torque acting on the shaft of the hoisting motor, i.e. the load condition. The load torque depends on the masses of the counterweight, car and ropes as well as the suspension ratios of the ropes and the transmission ratios of the gear system.

In a normal frequency converter controlled elevator drive, the motor is fed with a voltage of controlled frequency, which develops a sufficient torque for the desired acceleration and travelling speed. In a drive under four-quadrant control, when the motor is working in generator mode, the power generated by the motor can be returned into the supply network. Alternatively, the energy generated, or part of it, is converted into heat in resistors. The frequency converter is supplied with input data representing the actual values of the travelling speed of the elevator or the rotational speed of the motor, the load or torque and the voltage and possibly the current.

In a solution utilizing the invention, the frequency converter consists of a mains bridge 42 connected to the supply network and a motor bridge 46 connected to the motor. The motor bridge and the mains bridge are connected by a d.c. intermediate circuit, with a capacitor 44 connected between the intermediate circuit conductors 43 and 45. The two bridges are composed of controlled switches implemented e.g. as IGBTs. The bridges are controlled by a speed regulator 48, and the control is so implemented that the power supplied to the motor and the supply frequency as well as the power returned into the network are in accordance with the requirements of the operational situation. The energy stored in the intermediate circuit capacitor is utilized to cope with rapid load changes.

In each operational situation, the elevator is assigned a maximum power $P_A$ and a reference value for the rotational speed is determined accordingly. The allowed output power value, which is obtained from a power limiter 33, is e.g. one quarter of the nominal power of the elevator when the elevators are operated by the power generated by a reserve power generator. The allowed maximum output power value can also be defined by other means, such as a parameter given to the elevator control system.

The size of the counterweight used in the elevator drive is so chosen that, when the car load amounts to half the nominal load, a state of equilibrium prevails on the shafts of the traction sheave and the elevator motor. When the car load is smaller, a torque acting in the direction of the counterweight is present on the motor shaft, and when the car load exceeds half the nominal load, a torque acting in the direction of the car is present on the motor shaft. Thus, the load weight data provides a quantity directly proportional to the torque, and the driving power required by the machinery is proportional to the velocity and torque, or $P=wT_z$ and further $w=P/T$. By expressing these quantities as relative values com30 pared to the nominal values, we obtain $w_r=P_r/T_r$, where the subscript r means a relative value or $P_r=P/P_N$. Limiting the power to 25% of the nominal power therefore means a relative power value $P_r=0.25$. Thus, the reference for rotational speed is obtained directly from the power limit and the load weight data. The allowed power limit is given as a relative value corresponding to the proportion of reserve power, i.e. to the ratio of the reserve power allotted to the elevator to the nominal power. When several elevators are connected to the same reserve power generator, each elevator can be assigned an individual power limit, which means that the elevators share the total reserve power designed for the elevator drive.

The signal determining the allowed power $P_A$ and the load data (conductor 36) from the unit 37 are input to a divider 34, which determines the reference speed $\omega_{ref}=P_A/T_L$ possible with the available power, where $T_L$ is the load data. The speed reference $\omega_{ref}$ determined by the divider 34 is taken via conductor 38 to a speed regulator 48 in the frequency converter 26, whose output the speed regulator adjusts accordingly. Thus, the power taken by the frequency converter form the network remains within the prescribed limits. A tachometer 31 connected to the motor shaft provides the actual speed value ($\omega_{act}$, which is taken via conductor 39 to the speed regulator 48.

Depending on the load and travelling direction of the elevator, different load conditions can be distinguished. When the elevator is travelling with the car about half full, the load torque is very low and the power limit set according to the previous paragraph practically does not reduce the travelling speed at all. When the elevator is driving downwards with an empty car or upwards with a full car, the load is at a maximum and the travelling speed is reduced according to the power limit. The most advantageous situation in respect of energy consumption prevails when the elevator is travelling in the up direction with an empty car or in the down direction with a full car. In this situation, the power limit does not actually impose a limit on the driving speed of an individual elevator, but the elevator motor is working in generator mode, generating power that has to be either consumed or returned into the network. Of course, in all situations the motor has to produce the power for its magnetization and power dissipation.

When the elevator motor is operated in generator mode, it is advantageous to return the power generated into the network, so the energy can be used by other equipment connected to the reserve power network. If this is not possible, the power is dissipated in resistors. Another possibility is to operate the elevator in place, in which case the motor is fed with a zero-frequency current corresponding to the starting torque.

A relative power limit can be determined in several ways within the framework of the invention. Besides a preset relative value, the power limit may also be a function of a quantity representing the condition of the network. When the network voltage falls, this causes a stepwise reduction of the power limit.

Although the power control as presented in FIG. 1 is based on separate regulation of the elevators, it makes it possible, by monitoring the power consumption of different elevators, e.g. those belonging to the same elevator group, to alter the power limit for each elevator according to the load condition. The torque required for start-up has to be generated to enable the elevator to start moving. The speed and transport capacity of the elevator, i.e. the number or rather mass of passengers times the floor distance travelled per unit of time, is determined individually for each elevator. As the power limit is indicated as an amount of power consumed by the elevator, it does not limit the speed when the motor is working in generator mode. An elevator travelling with a full load in the down direction, which is the usual situation during evacuation, is advantageous in respect of power consumption as stated before and in fact generates power as the motor is working in generator mode. The motor can be run at full speed, which means that the transport capacity is at a maximum, i.e. the elevator is travelling with maximum load at full speed. The power thus generated must be consumed in some way or returned into the network. On the other hand, when the load is small, only a low speed is allowed in the down direction. In contrast, an empty car in the up direction or, as is often the case in an emergency, a car with one rescue worker in the up direction provides a similar advantage, as stated above.

In the above, the invention has been described by the aid of some of its embodiments. However, the examples are not to be regarded as limiting the sphere of patent protection, but the embodiments of the invention can be varied within the limits defined by the following claims.

We claim:

1. A velocity controlled elevator drive comprising:

an elevator motor driving an elevator;

a detector detecting a load condition of the elevator;

a power limiter determining a power limit representing a share of reserve power allocated to said elevator; and a frequency converter supplying the elevator motor with a controlled frequency and voltage based on a reference speed as determined from the power limit defined by said power limiter and the load condition detected by said detector.

2. Elevator drive according to claim 1, wherein the power limit is a relative value in relation to nominal power of the elevator.

3. Elevator drive according to claim 1, wherein the load condition is determined from a measurement signal give by a load weighing device in an elevator car.

4. Elevator drive according to claim 1, wherein the power limit is determined according to power supply capacity of a network.

* * * * *